United States Patent [19]

Bengtson et al.

[11] Patent Number: 5,007,218

[45] Date of Patent: Apr. 16, 1991

[54] MASONRY BLOCK WALL SYSTEM AND METHOD

[75] Inventors: Fred G. Bengtson, Tempe; Donald V. LoPiccolo, Phoenix, both of Ariz.

[73] Assignee: Superlite Builders Supply, Inc., Phoenix, Ariz.

[21] Appl. No.: 918,465

[22] Filed: Oct. 14, 1986

Related U.S. Application Data

[63] Continuation of Ser. No. 599,526, Apr. 12, 1984, abandoned.

[51] Int. Cl.[5] ..... E04B 1/06; E06B 1/04

[52] U.S. Cl. ..... 52/204; 52/228; 52/293; 52/295; 52/566

[58] Field of Search ..... 52/228, 565, 566, 204, 52/309.12, 227, 293, 294, 295

[56] References Cited

U.S. PATENT DOCUMENTS

| | | | |
|---|---|---|---|
| 729,408 | 5/1903 | Pickin | 52/228 |
| 1,704,255 | 3/1929 | Lewis | 52/293 |
| 2,141,397 | 12/1938 | Locke | 52/204 |
| 2,241,169 | 5/1941 | Yokes | 52/228 |
| 2,325,614 | 8/1943 | Klaber | 52/204 |
| 2,627,176 | 2/1953 | Levy | 52/293 |
| 2,634,601 | 4/1953 | Tillery | 52/293 |
| 2,684,589 | 7/1954 | Perreton | 52/293 |
| 2,815,656 | 12/1957 | Klein et al. | 52/293 |
| 2,835,126 | 5/1958 | Paolella | 52/293 |
| 2,929,236 | 3/1960 | Steward et al. | 52/228 |
| 3,186,400 | 6/1965 | Lunt et al. | 52/204 |
| 3,378,969 | 4/1968 | Larger | 52/228 |
| 3,475,873 | 11/1969 | Steadman | 52/293 |
| 3,601,942 | 8/1971 | Wilson | 52/293 |
| 3,717,967 | 2/1973 | Wood | 52/566 |
| 3,881,289 | 5/1975 | Mauroner | 52/293 |
| 4,040,215 | 8/1977 | Totsuka | 52/294 |
| 4,190,999 | 3/1980 | Hampton | 52/565 |
| 4,207,718 | 6/1980 | Schaaf et al. | 52/293 |
| 4,315,391 | 2/1982 | Piazza | 52/309.12 |
| 4,429,499 | 2/1984 | Kato | 52/228 |

FOREIGN PATENT DOCUMENTS

| | | | |
|---|---|---|---|
| 817198 | 10/1951 | Fed. Rep. of Germany | 52/216 |
| 882577 | 11/1961 | United Kingdom | 52/228 |

*Primary Examiner*—Michael Safavi

*Attorney, Agent, or Firm*—Cahill, Sutton & Thomas

[57] ABSTRACT

A masonry block system is disclosed incorporating a plurality of courses of masonry block, each block of which is formed with minimum webbing to minimize heat flow therethrough. The wall system is formed into a unitary structure through the utilization of post-tensioning rods tied to reinforcing rods in the wall footer and extending through the voids in the respective blocks to a top plate positioned on top of the wall. The rods are threaded and are post-tensioned; the voids contain a polyurethane foam.

2 Claims, 2 Drawing Sheets fig. 1

MASONRY BLOCK WALL SYSTEM AND METHOD

This is a continuation of application, Ser. No. 599,526, filed Apr. 12, 1984 now abandoned.

FIELD OF THE INVENTION

The present invention relates to wall structure and methods, and particularly to a load bearing masonry block residential wall system and method using steel post-tensioning rods.

DESCRIPTION OF THE PRIOR ART

The advantages of masonry construction for residential structural walls are many and include virtual freedom from maintenance as well as structural strength and freedom from insect damage or deliterious effects of aging. However, a desirable characteristic of a residential wall system is a low heat conductivity. The insulation value of a wall has become more important in recent times and the need for the wall to act as a heat barrier has become extremely important. Unfortunately, conventional masonry walls exhibit rather poor insulation characteristics such that other types of structural systems have become more widespread. These other systems, usually wood frame construction or variations thereof, exhibit all of the undesirable characteristics inherent in wood construction including termite susceptibility, fire hazard, possibility of dry rot, dimensional instability, as well as great variation in quality of wood.

Thermal conductivity is a measure of a material's ability to transmit heat therethrough. Wall structures are always composite structures such that the thermal conductivity of an entire wall system is a sum of the conductivities of the individual part. For example, insulation material within a wall may have a very low heat conductivity whereas the denser materials such as grouting or mortar will have a higher thermal conductivity. In the air conditioning and insulation industries, it has been found more convenient not to rate the individual wall systems in terms of their thermal conductivity, but rather with regard to their thermal resistance. Thermal resistance, or "R" value, is simply a reciprocal of conductivity and is a measure of the wall's ability to insulate, rather than transmit, heat on one side of the wall from the other side of the wall. Therefore, in the comparison of different wall systems, the "R" value is frequently used as a measure of that wall systems ability to insulate the interior of a dwelling from the temperature on the exterior of the dwelling.

When comparing the thermal characteristics of the masonry wall versus the wood frame wall, the frame structure usually is far superior, particularly in view of the fact that it is easily insulated. For example, a typical frame construction will consist of spaced studs having four or six inch thickness perpendicular to the wall structure, the outside of which will be covered by plywood or a composition board of some type which in turn will be covered by a siding material or perhaps a composition such as stucco. Typical fiberglass batting is then placed between the studs and the interior wall finished with plaster board or similar interior wall finish. The resulting composite wall structure will normally exhibit an "R" value of from 12 to 20. A typical masonry block construction will include successive courses of masonry block with the inside surface of the wall being furred with wall board placed on the surface of the furring. The wall may or may not include a thin sheet of insulation material and is usually finished on the outside either by applying stucco or simply painting. In some instances, the masonry structure will include insulating material placed in the voids of the respective blocks. Such block structures typically have "R" values ranging from 6 to 10.

Thus, it may be seen that although the masonry construction incorporates substantial advantages over a corresponding frame system, the wood frame wall nevertheless presents substantial advantages in the area of heat insulation.

OBJECTS OF THE INVENTION

It is therefore an object of the present invention to provide a wall system incorporating masonry structural techniques while nevertheless providing a high thermal resistance value.

It is also an object of the present invention to provide a novel method for constructing a masonry type wall structure to provide in economical means for erecting a masonry wall having a substantially higher thermal resistance than heretofor achievable in conventional masonry wall structures.

It is another object of the present invention to provide a masonry wall structure that eliminates the use of grout or any other similar substance that would increase the conductivity of the wall structure.

It is still another object of the present invention to provide a masonry wall structure incorporating post-tensioning rods as a means for assuring structural integrity and withstanding wind loads.

These and other objects of the present invention will become apparent to those skilled in the art as the description thereof proceeds.

SUMMARY OF THE INVENTION

Briefly, the wall structure and method of the present invention utilizes vertically extending post-tensioning rods that are anchored in the footing of the wall; further, these post-tensioning rods are sectioned to provide convenient erection during the construction of the wall. No conventional reinforcing bar or grouting is used in the wall structure; rather, polyurethane foam is injected into the voids in the masonry blocks while the vertically extending rods extend through a plate positioned on top of the wall. The rods are post-tensioned to a predetermined value; special steel lintels over doorways and window openings provide continuity to the post-tensioning technique while sill blocks having openings therein permit access to the interior of the wall for the injection of polyurethane in those places normally considered inaccessible.

BRIEF DESCRIPTION OF THE DRAWINGS

The present invention may more readilY be described by reference to the accompanying drawings in which.

DETAILED DESCRIPTION OF THE PREFERRED EMBODIMENT

Figure 1:
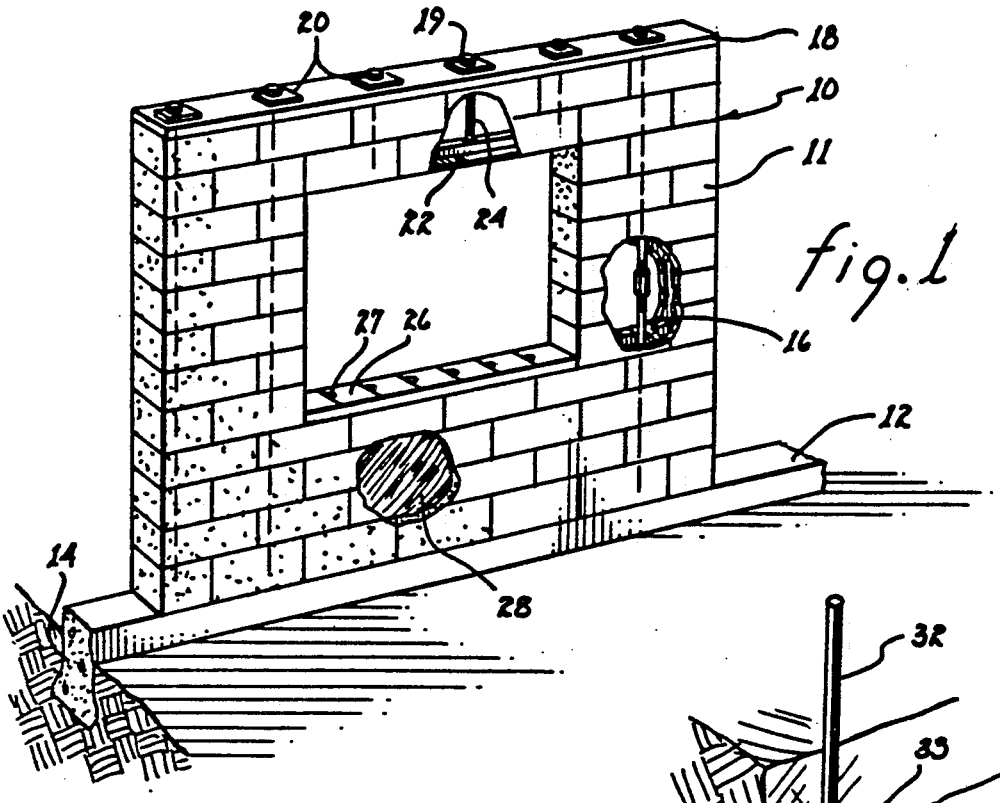
FIG. 1 is a perspective view of a masonry block wall system incorporating the teachings of the present invention.

Referring to FIG. 1, a masonry block wall 10 is shown comprising a plurality of courses of masonry blocks 11 constructed on a stem wall 12 extending from a footer 14. The wall includes a plurality of vertically extending post-tensioning rods such as that shown at 16, each of which extends through the voids in the respective masonry blocks through a top plate 18. The post-tensioning rods 16 terminate above the plate 18 and are tensioned through the use of nuts 19 bearing upon steel washers 20. The wall also includes a steel lintel 22 which has welded thereto post-tensioning rods such as that shown at 24. Further, the sill incorporates a plurality of sill block 26, each of which is provided with an opening such as that shown at 27 for the admission of polyurethane foam. The wall is filled with urethane foam such as that shown at 28.

Figure 2:
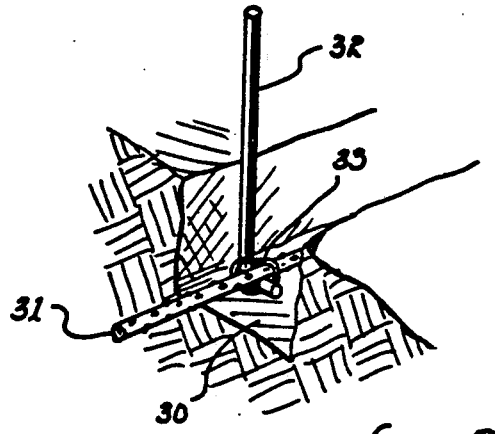
FIG. 2 is a perspective view of a vertically extending rod attached to a reinforcing bar in the form provided for the footer of the wall of FIG. 1.

The wall is constructed by first providing a footer form such as the trench shown at 30 in FIG. 2; the footer includes an anchoring means that may take various forms such as the reinforcing bar 31 positioned horizontally therein and to which is attached a plurality of vertically extending post-tensioning rods such as that shown at 32 in FIG. 2. It may be noted that the bottom portion of the rods 32 are upset and wired to the reinforcing bar 31 by any convenient means such as clips or wire 33. The vertically extending post-tensioning rods 32 through 34 are spaced along the wall at predetermined intervals depending on the specific design of the individual wall, the load the wall is to carry, and other miscellaneous design considerations. Normally, the spacing between adjacent vertically extending post-tensioning rods will be from two feet to six feet. The number of rods indicated in FIG. 1 are for purposes of illustration and are not necessarily correctly spaced.

Figure 3:
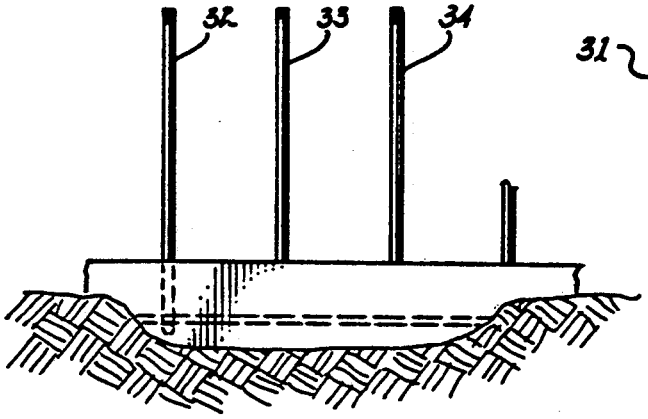
FIGS. 3 and 4 are illustrations of partially completed walls constructed in accordance with the method of the present invention.

After the rods are attached to the horizontal reinforcing bar as shown in FIG. 2, the concrete footer is poured and, in most instances, a stem wall such as that shown at 12 will be poured on top of the footer. For simplicity, the term "footer" as used herein includes a stem wall if and when the latter is used. As shown in FIG. 3, the vertically extending rods 32, 33 and 34 are spaced along the wall and extend for a vertical distance substantially less than the height of the wall. In practice, it has been found that the wall system of the present invention may be constructed most expeditously if the vertical length of the rods 32–34 as shown in FIG. 3 is kept to approximately four feet. It will also be noted that each of the vertically extending rods 32–34 are threaded at the respective ends thereof.

Figure 4:
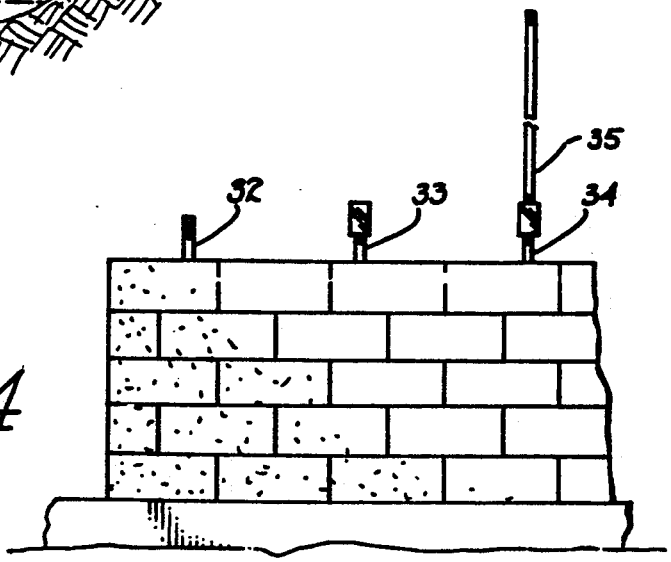
Figure 8:
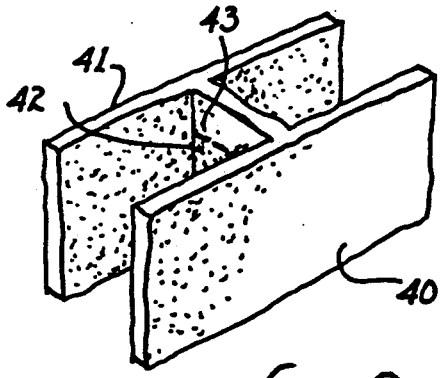
FIG. 8 is a perspective view of a typical masonry block used in the wall system of the present invention.

Masonry block is then laid on the footer or stem wall as shown in FIG. 4 using conventional masonry techniques with mortar joints. Because of the method and structure of the present invention however, the masonry block may be chosen to be particularly light with a minimum of webbing. For example, the configuration shown in FIG. 8 is illustrative of the type of light weight block that may be used in the wall structure of the present invention. It may be seen that the faces 40 and 41 are interconnected by only a single web member 42 which may be relatively thin in cross-section; in fact, it may be possible for the webbing 42 to be significantly shortened such as shown in FIG. 8 by the broken line 43.

When several courses of masonry block have been laid, such as shown in FIG. 4, a second section such as that shown at 35 is connected to each of the corresponding vertical rods. These second sections extend vertically a distance sufficient to extend through the remaining wall height and through the top plate 18 shown in FIG. 1. It is important to note that the vertically extending post-tensioning rods do not contact the masonry block, nor are they held in position with grouting or other typically masonry products.

When all of the courses of the wall have been completed, polyurethane foam, or similar injectable foaming insulation material, is inJected into the voids provided in all of the masonry blocks. Thus the entire interior of the wall is filled with urethane foam. The specific composition of the insulation, and manner in which the block voids are filled may be chosen from numerous prior art available techniques. It may also be possible to inject the urethane foam at various stages of completion of the wall; that is, it may be possible to inject foam after only several courses have been completed although it is more desirable to postpone the foam injection until the last course has been completed.

When the injected foam has set, a wood plate such as that shown at 18 in FIG. 1, having predrilled holes therein to admit the respective post-tensioning rods, is placed on top of the wall; plate washers such as those shown at 20 in FIG. 1 are then placed over the ends of the rods and a nut is threaded on each rod and tightened to a predetermined value. While the specifics of any particular wall will vary from other walls, it has been found that a typical residential load bearing masonry block construction will use 7/16" smooth post-tensioning rods that are post-tensioned to approximately 2200 pounds each.

Figure 5:
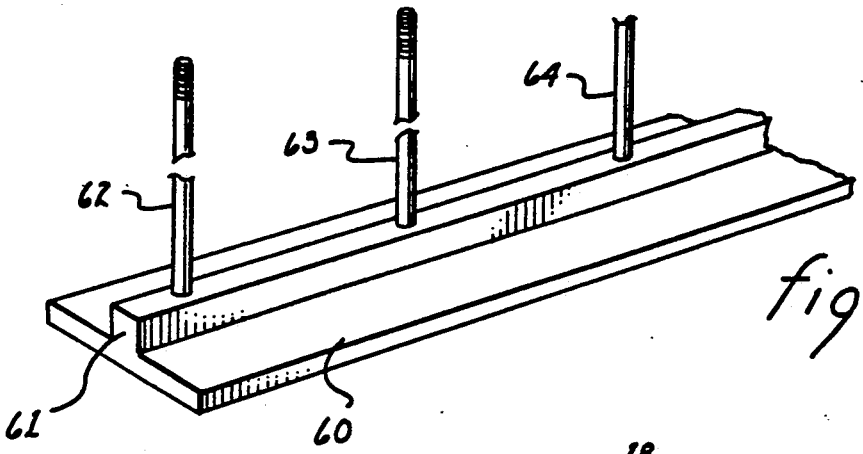
FIG. 5 is an isometric view of a steel lintel incorporated in the wall system of the present invention.
Figure 6:
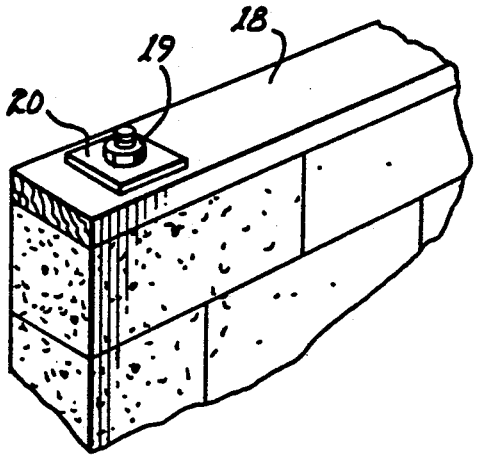
FIG. 6 is a view of a portion of the wall of FIG. 1 showing a post-tensioned rod extending through the top plate thereof.

When openings are provided in the wall, such as the window opening shown in FIG. 1, a steel lintel is provided to provide continuity to the post-tensioning. Referring to FIG. 5, a typical steel lintel 60 is shown having a reinforcing ridge 61 formed integral therewith or welded thereto; further, post-tensioning rods 62, 63 and 64 are welded to the lintel in accordance with the predetermined spacing. The post-tensioning rods extend vertically a sufficient distance to protrude through the top plate of the wall; each of the rods 62–64 is threaded to accept a nut for tensioning. It may be noted that post-tensioning the rods 62–64 will not result in the anchoring of the wall to the footer; rather, the vertically extending post-tensioning rods extending from the steel lintel will insure structural integrity and unity to that portion of the wall over the opening or window and will lock that portion of the wall to the adjacent portions of the wall having vertically extending post-tensioning rods extending from the top plate into the footer.

Figure 7:
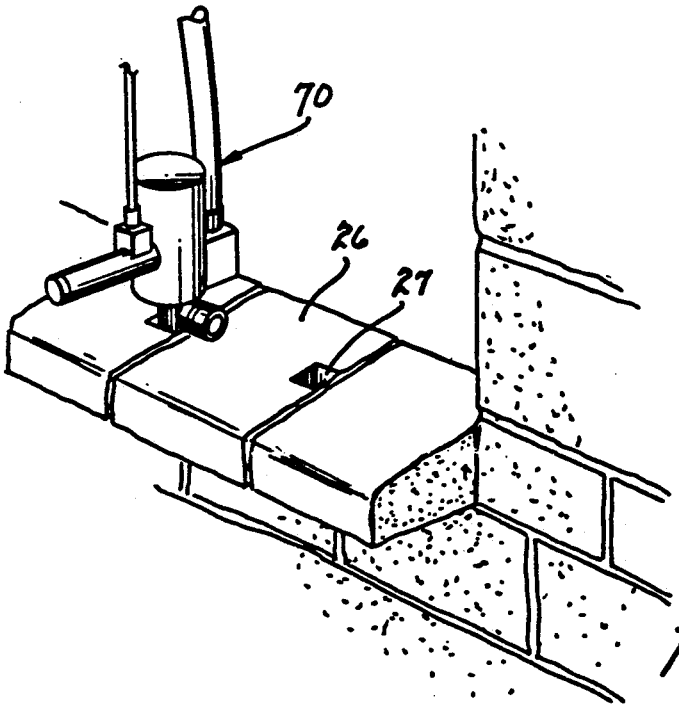
FIG. 7 is a perspective view of masonry sill blocks having openings therein and showing a typical polyurethane injection gun used for injecting foam in the wall system of the present invention.

The sills of such opening as the window opening shown in FIG. 1 are provided with sill blocks 26 as most clearly shown in FIG. 7. Each of the sill blocks includes an opening 27 to permit the injection of polyurethane foam into that portion of the wall beneath the window. The apparatus 70 shown in FIG. 7 is a typical urethane injecting gun shown positioned to inject urethane foam into one of the openings 27 in the sill block 26.

Those skilled in the art will recognize that many modifications may be made in the present invention without departing from the spirit thereof. For example, it may be desirable to use horizontal joint reinforcing in the form of a spaced wire mesh in some particular applications. This latter technique is well known and need not be discussed here. Similarly, the specific spacing of the post-tensioning rods, as well as the rod diameter and the particular tension placed on the rod may vary from that described. In some instances, it may be possible for the anchoring means to be imbedded in the stem wall, and a tying arrangement provided to transmit force of the post-tensioning rods to the footer. In such circumstances, for purposes of the present invention, the stem will be considered as part of the footer.

We claim:

1. A wall structure comprising:

(a) a concrete footer having an anchoring means therein;

(b) a plurality of post-tensioning rods connected to said anchoring means and extending vertically from said footer;

(c) a plurality of stacked masonry building blocks arranged in courses with mortar therebetween and having voids therein;

(d) a plate positioned on the top course of said blocks;

(e) said rods extending through said voids in non-contacting relationship to said blocks, grouting or other masonry products and through said plate;

(f) tensioning means mounted on said plate and secured to said post-tensioning rods for maintaining a predetermined tension in said rods;

(g) said masonry building blocks each having opposing parallel faces interconnected by a single web member;

(h) means defining thermal insulation material in said voids to increase the thermal resistance of said wall structure to provide a wall structure having an R value greater than 10; and (i) a steel lintel member extending over an opening provided in said wall structure, said lintel including a plurality of vertically extending rods connected thereto, each of said rods extending through voids in said blocks positioned above said lintel.

2. The combination set forth in claim 1 including a plurality of sill blocks positioned along the bottom of the opening provided in said wall, each of said sill blocks including an opening therein to permit the injection of insulating material into the wall beneath said sill blocks.

* * * * *

US005007218B1

REEXAMINATION CERTIFICATE (2845th)

United States Patent [19] [11] B1 5,007,218

Bengtson et al. [45] Certificate Issued Apr. 16, 1996

[54] MASONRY BLOCK WALL SYSTEM AND METHOD

[75] Inventors: Fred G. Bengtson, Tempe; Donald V. LoPiccolo, Phoenix, both of Ariz.

[73] Assignee: Superlite Block, Phoenix, Ariz.

Reexamination Request:
No. 90/003,478, Jun. 29, 1994

Reexamination Certificate for:

| | |
|---|---|
| Patent No.: | **5,007,218** |
| Issued: | **Apr. 16, 1991** |
| Appl. No.: | **918,465** |
| Filed: | **Oct. 14, 1986** |

Related U.S. Application Data

[63] Continuation of Ser. No. 599,526, Apr. 12, 1984, abandoned.

[51] Int. Cl.[6] ..... E04B 1/06; E06B 1/04

[52] U.S. Cl. ..... 52/204.2; 52/223.7; 52/293.2; 52/295; 52/566

[56] References Cited

U.S. PATENT DOCUMENTS

| | | | |
|---|---|---|---|
| 1,704,255 | 3/1929 | Lewis | 52/293.2 |
| 2,239,529 | 4/1941 | Knudsen . | |
| 2,361,828 | 10/1944 | Drayer . | |
| 2,929,236 | 3/1960 | Steward et al. | 52/223.7 |
| 3,717,967 | 2/1973 | Wood | 52/566 |
| 4,106,247 | 8/1978 | Svensson . | |
| 4,315,391 | 2/1982 | Piazza | 52/309.12 |

OTHER PUBLICATIONS

Ga–Po Products Co.; Catalogue p. B13 1979.

Ga–Po Products Co.; Catalogue p. B14 1979.

*Primary Examiner*—Michael Safavi

[57] ABSTRACT

A masonry block system is disclosed incorporating a plurality of courses of masonry block, each block of which is formed with minimum webbing to minimize heat flow therethrough. The wall system is formed into a unitary structure through the utilization of post-tensioning rods tied to reinforcing rods in the wall footer and extending through the voids in the respective blocks to a top plate positioned on top of the wall. The rods are threaded and are post-tensioned; the voids contain a polyurethane foam.

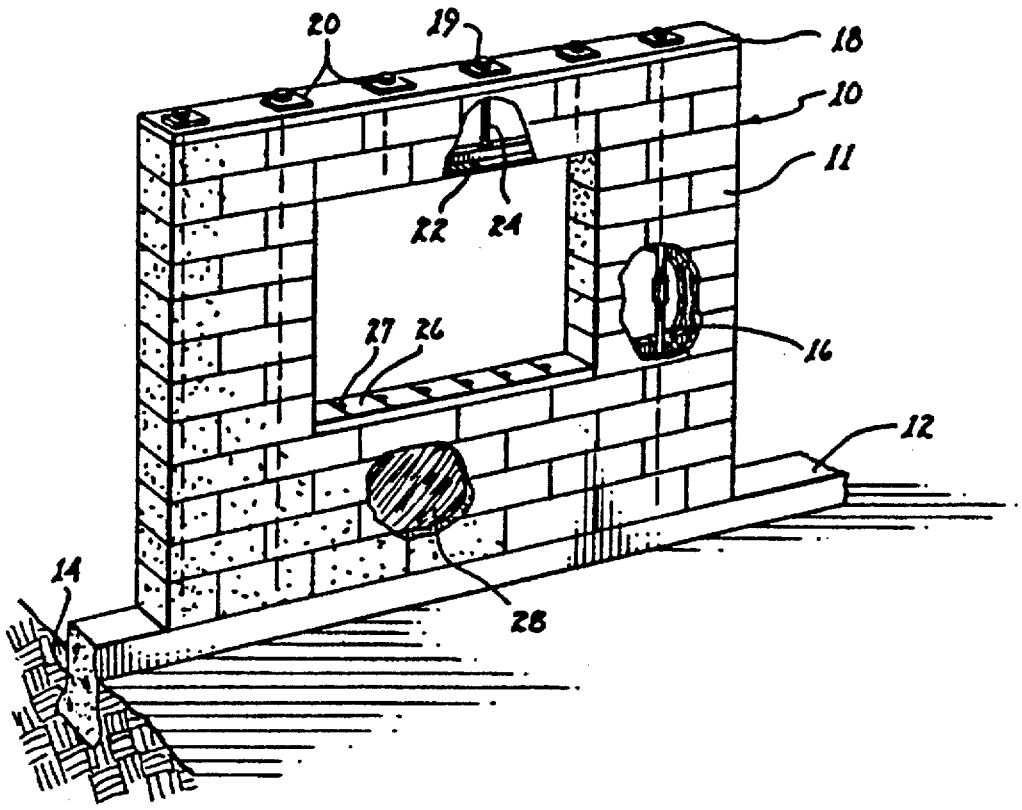

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claim 2, dependent on an amended claim, is determined to be patentable.

1. A wall structure comprising:

(a) a concrete footer having an anchoring means therein;

(b) a plurality of post-tensioning rods connected to said anchoring means and extending vertically from said footer;

(c) a plurality of stacked masonry building blocks arranged in courses with mortar therebetween and having voids therein;

(d) a plate positioned on the top course of said blocks;

(e) said rods extending through said voids in non-contacting relationship to said blocks, grouting or other masonry products and through said plate;

(f) tensioning means mounted on said plate and secured to said post-tensioning rods for maintaining a predetermined tension in said rods;

(g) said masonry building blocks each having opposing parallel faces interconnected by a single web member;

(h) means defining thermal insulation material in said voids to increase the thermal resistance of said wall structure to provide a wall structure having an R value greater than 10; and (i) a steel lintel member extending over an opening provided in said wall structure, said lintel including a plurality of vertically extending *post-tensioning* rods connected thereto, each of said rods extending through voids in said blocks positioned above said lintel.

* * * * *